US011479436B2

(12) United States Patent
Tsai

(10) Patent No.: US 11,479,436 B2
(45) **Date of Patent: *Oct. 25, 2022**

(54) FIBER PRODUCT SUCTION SYSTEM

(71) Applicant: CHAN LI MACHINERY CO., LTD., Taoyuan (TW)

(72) Inventor: Tung-I Tsai, Taoyuan (TW)

(73) Assignee: CHAN LI MACHINERY CO., LTD., Taoyuan (TW)

( * ) Notice: Subject to any disclaimer, the term of this patent is extended or adjusted under 35 U.S.C. 154(b) by 390 days.

This patent is subject to a terminal disclaimer.

(21) Appl. No.: 16/655,734

(22) Filed: Oct. 17, 2019

(65) Prior Publication Data

US 2020/0140223 A1 May 7, 2020

(30) Foreign Application Priority Data

Nov. 2, 2018 (TW) ..... 107138949

(51) Int. Cl.
*B65H 45/101* (2006.01)

(52) U.S. Cl.
CPC ..... *B65H 45/101* (2013.01)

(58) Field of Classification Search
CPC ..... B65H 45/24; B65H 45/101; B65H 2406/361; B65H 2406/3612; B65H 2406/3614
See application file for complete search history.

(56) References Cited

U.S. PATENT DOCUMENTS

| | | | | |
|---|---|---|---|---|
| 11,034,541 | B2 * | 6/2021 | Mencarini | B65H 45/28 |
| 11,104,540 | B2 * | 8/2021 | Tsai | B65H 31/32 |
| 2002/0140151 | A1 * | 10/2002 | Couturier | B65H 45/101 270/58.07 |
| 2004/0250706 | A1 * | 12/2004 | De Matteis | B65H 5/226 100/121 |
| 2012/0065045 | A1 * | 3/2012 | De Matteis | B65H 27/00 493/442 |

FOREIGN PATENT DOCUMENTS

CN 108016930 A * 5/2018

* cited by examiner

*Primary Examiner* — Patrick H Mackey
(74) *Attorney, Agent, or Firm* — Kusenbekg, Klein & Lee

(57) ABSTRACT

The invention provides a fiber product suction system, comprising a folding wheel and a plurality of valves. The folding wheel comprises a plurality of protruding wheels and a plurality of recessing wheels adjacent each other. A plurality of suction channels and at least one connecting channel are disposed within the protruding wheel, wherein the connecting channel is fluidly connected to the suction channel. The valve is disposed on the recessing wheel of the folding wheel, and includes a connecting opening, a valve channel and a plurality of valve openings, wherein the valve openings are disposed on two sides of the valve, and are fluidly connected to the connecting opening via the valve channel. An air extractor can extract the gas in each suction channel through the valve, and generate a negative pressure on part of suction channels of the protruding wheel, so that the fiber product suction system can be used to suck and fold paper.

10 Claims, 10 Drawing Sheets

FIBER PRODUCT SUCTION SYSTEM

REFERENCE TO RELATED APPLICATIONS

This non-provisional application claims priority claim under 35 U.S.C. § 119(a) on Taiwan Patent Application No. 107138949 filed Nov. 2, 2018, the entire contents of which are incorporated herein by reference.

FIELD OF THE INVENTION

The present invention relates to a fiber product suction system, and more particularly to a fiber product suction system for sucking and folding paper.

BACKGROUND

FIG. 1 is a cross section view of a folding wheel according to the prior art. FIG. 2 is a cross section view of a protruding wheel of the folding wheel according to the prior art. The folding wheel 10 mainly includes a shaft 11, a wheel 12 and a passage 13, wherein the passage 13 is parallel to the axial direction of the shaft 11 and extends through the entire wheel 12 or the shaft 11. The wheel 12 includes a plurality of protruding wheels 121 and a plurality of recessing wheels 120, wherein each of the protruding wheels 121 is provided with a plurality of suction channels 1212/1214 connected to the passage 13.

At least one air extractor 15 is connected to the passage 13. For example, the air extractor 15 is connected to two ends of the passage 13 through two connecting pipes 17. The paper is sucked by the suction channels 1212/1214 on the protruding wheel 121, and then folded by the folding wheel 10.

Specifically, when the suction channels 1212/1214 are rotated to a preset position, the air extractor 15 will extract the gas within the suction channels 1212/1214 via the connecting pipes 17 and the passage 13 so that the openings of the suction channels 1212/1214 will form a negative pressure to suck the paper onto the wheel 12.

However, the passage 13 only has two openings located at two ends of the folding wheel 10, and the air extractor 15 is connected to two openings of the passage 13 through two connecting pipes 17, so that the negative pressure generated on the middle of the folded wheel 10 may be insufficient or uneven. When the length of the folding wheel 10 or the passage 13 is too long, or the rotation speed is faster, the paper may fall from the folding wheel 10, thereby affecting the quality of the folded paper.

SUMMARY

An object of the present invention is to provide a fiber product suction system comprising a folding wheel and a plurality of valves. The folding wheel comprises a plurality of protruding wheels and a plurality of recessing wheels that are adjacently arranged on a shaft. The protruding wheel is provided with a plurality of connecting channels and a plurality of suction channels, wherein the suction channel is connected to the top surface of the protruding wheel and the connecting channel. The air extractor can extract the gas in the suction channels through the plurality of valves and the connecting channels, so that the suction channels at the top surface of the protruding wheel will generate an even negative pressure, and the paper will be quickly sucked on the folding wheel or released from the folding wheel.

It is an object of the present invention to provide a fiber product suction system in which valves are disposed in a part of recessing wheels, and at least recessing wheel between adjacent two valves does not dispose the valve. Each valve includes a connecting opening, a valve channel and a plurality of valve openings, wherein the connecting opening is connected to the connecting channel and the suction channel of the corresponding protruding wheel via the valve channel and the valve opening. The air extractor can extract the gas in the suction channels on two adjacent protruding wheels via a valve to quickly form the negative pressure on the folding wheel, so that the paper can be quickly sucked on the folding wheel or released from the folding wheel.

It is another object of the present invention to provide a fiber product suction system comprising a folding wheel and a plurality of valves. The folding wheel comprises a plurality of protruding wheels and a plurality of recessing wheels. The top surface of each protruding wheel has a plurality of protrusions and a plurality of grooves, wherein the protrusions and the grooves are provided with a suction channel. The valve is fluidly connected to the suction channel via the connecting channel, and when the air extractor is activated, the suction channels adjacent to part of protrusion and/or grooves will generate the negative pressure to suck the paper.

The present invention provides a fiber product suction system comprising: a folding wheel including a plurality of protruding wheels and a plurality of recessing wheels, wherein the protruding wheel and the recessing wheel are disposed adjacent to each other; a plurality of suction channels disposed in the protruding wheel; at least one connecting channel disposed in the protruding wheel and being fluidly connected to the suction channel; and a plurality of valves including a connecting opening, a valve channel and a plurality of valve openings, wherein the connecting opening is fluidly connected to the valve opening through the valve channel, the plurality of valves are respectively disposed in part of the recessing wheels, and the valve opening is fluidly connected to the connecting channel of the protruding wheel adjacent to the valve.

BRIEF DESCRIPTION OF THE DRAWINGS

The structure as well as preferred modes of use, further objects, and advantages of this invention will be best understood by referring to the following detailed description of some illustrative embodiments in conjunction with the accompanying drawings, in which.

DETAILED DESCRIPTION OF THE PREFERRED EMBODIMENTS

Figure 3:
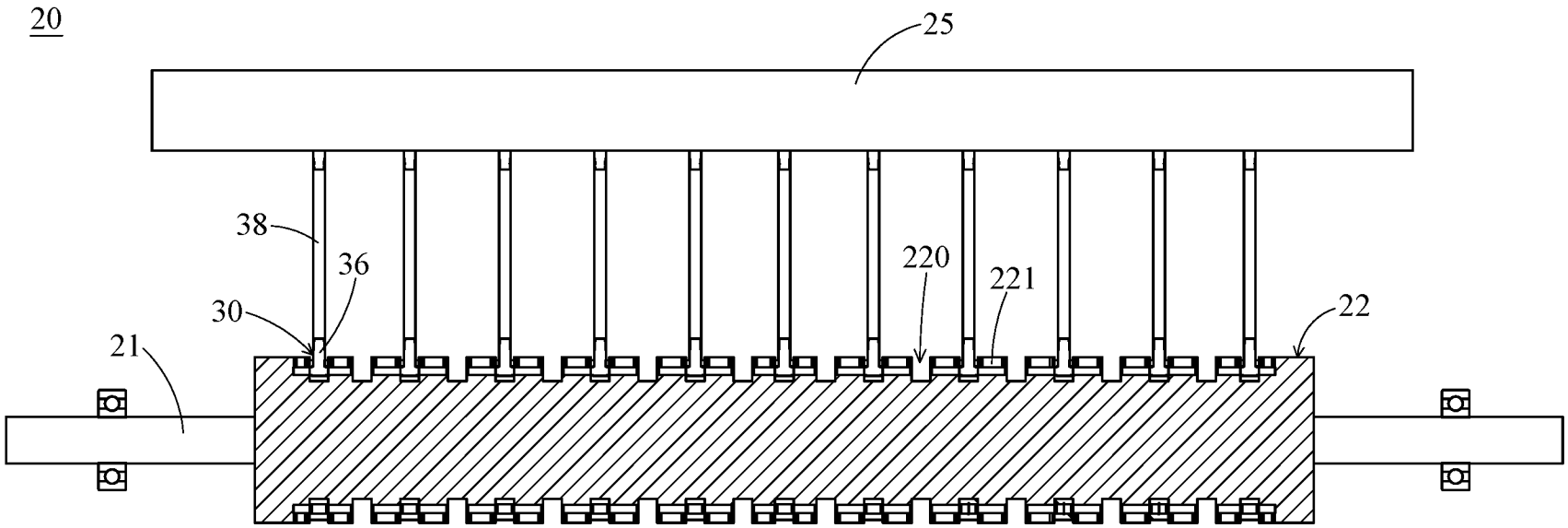
FIG. 3 is a cross sectional view of a fiber product suction system according to an embodiment of the invention.
Figure 4:
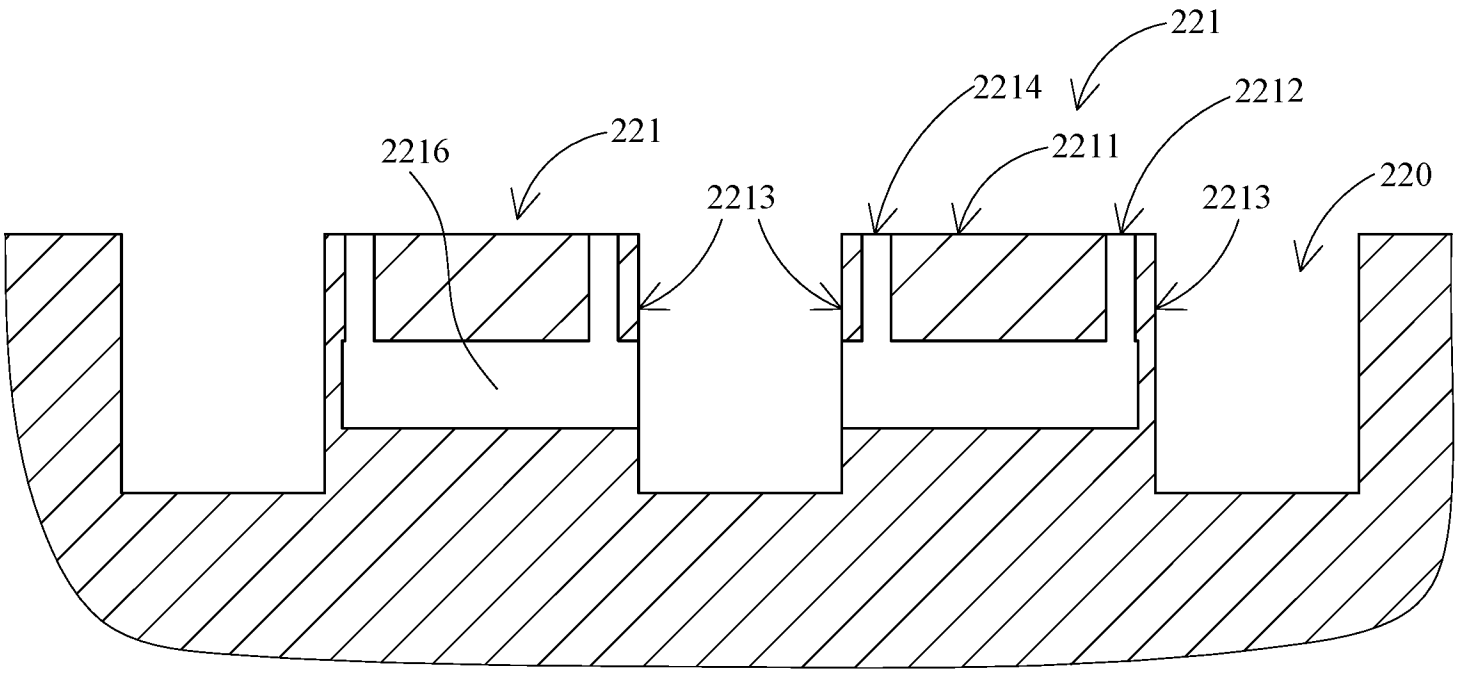
FIG. 4 is a cross sectional view of a folding wheel of fiber product suction system according to an embodiment of the invention.
Figure 5:
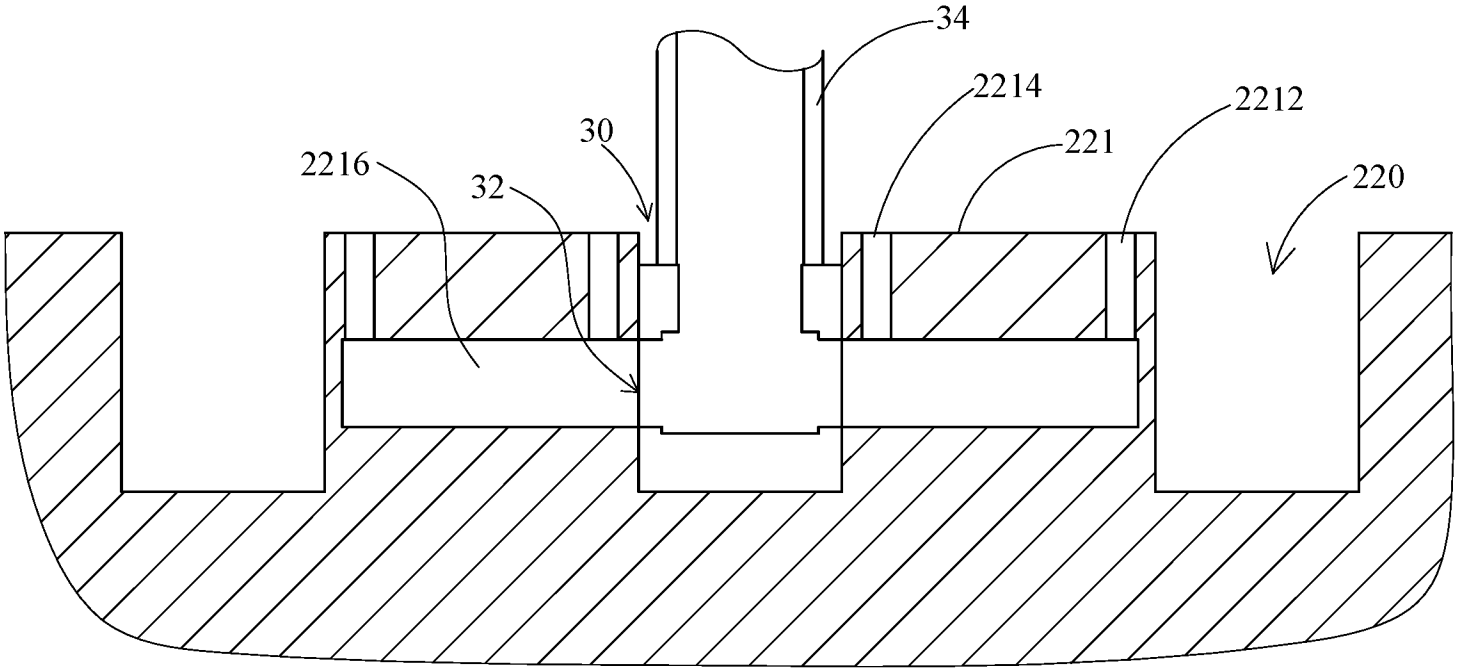
FIG. 5 is a cross sectional view of a folding wheel and a valve of a fiber product suction system according to an embodiment of the invention.
Figure 6:
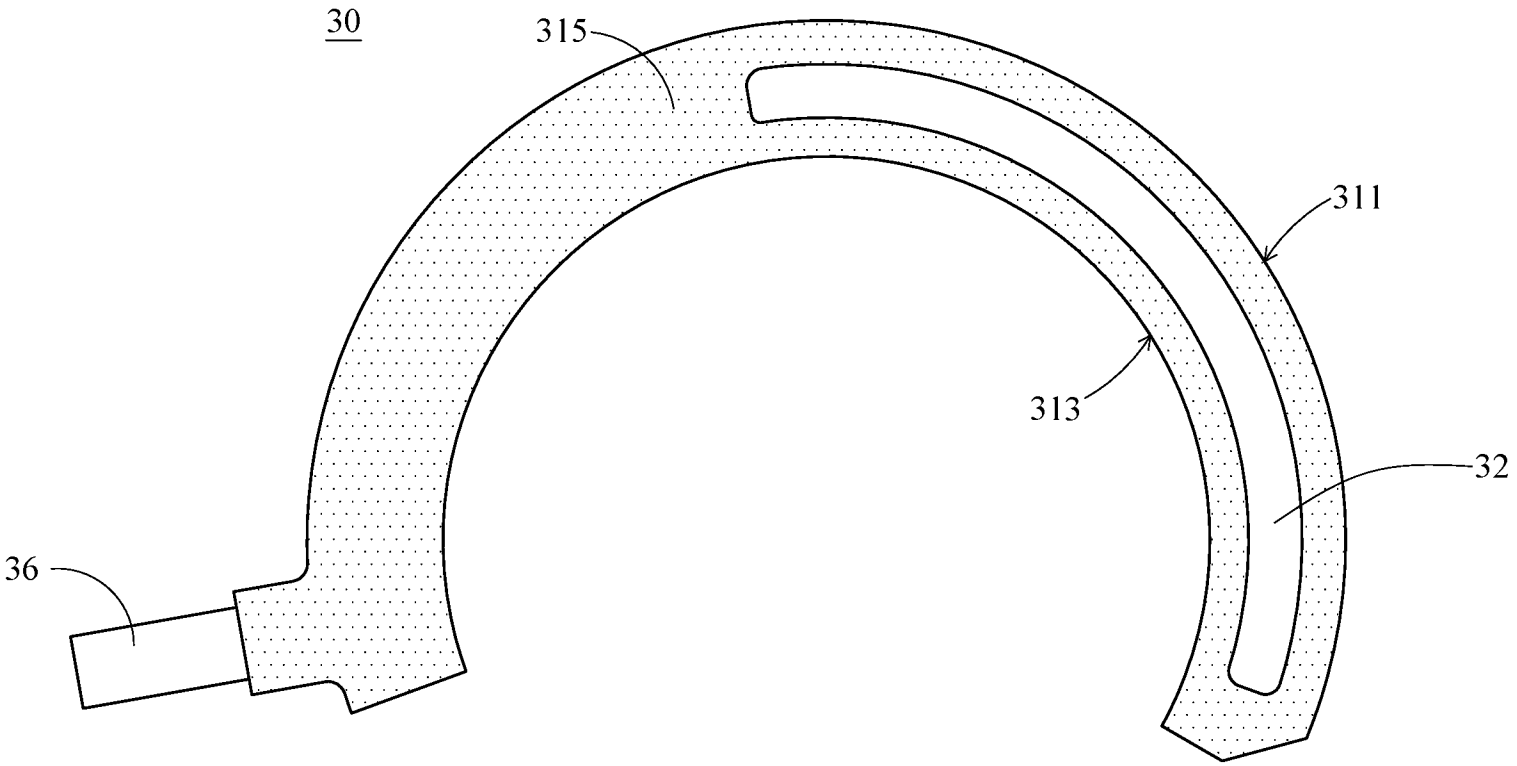
FIG. 6 is a side view of a valve of a fiber product suction system according to an embodiment of present invention.
Figure 7:
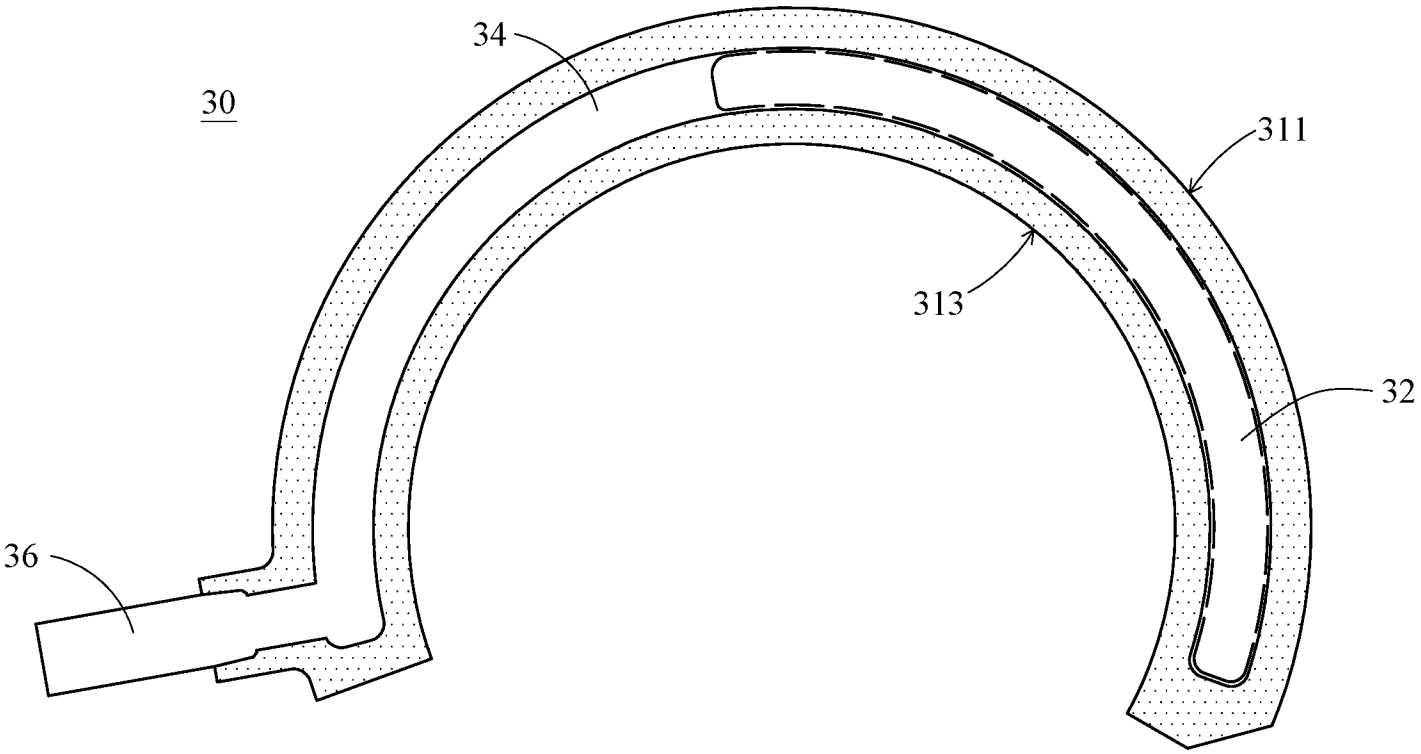
FIG. 7 is a cross section view of a valve of a fiber product suction system according to an embodiment of present invention.

FIG. 3 is a cross sectional view of a fiber product suction system according an embodiment of the present invention. FIG. 4 is a cross sectional view of a folding wheel of a fiber product suction system according an embodiment of the present invention. FIG. 5 is a cross sectional view of a folding wheel and a valve of a fiber product suction system according to an embodiment of the present invention. FIG. 6 is a side view of a valve of a fiber product suction system according to an embodiment of the present invention. FIG. 7 is a cross sectional view of a valve of a fiber product suction system according to an embodiment of the present invention.

The fiber product suction system of the present invention is used for sucking a fiber product, such as a paper, and folding the fiber product. The fiber product suction system mainly comprises a folding wheel 20 and a plurality of valves 30, wherein the folding wheel 20 further includes a shaft 21 and a wheel 22.

The wheel 22 includes a plurality of protruding wheels 221 and a plurality of recessing wheels 220, wherein the protruding wheel 221 and the recessing wheel 220 are adjacently arranged on the shaft 21. At least one connecting channel 2216 and a plurality of suction channels 2212/2214 are disposed within each of the protruding wheels 221, wherein the connecting channel 2216 is fluidly connected to the suction channels 2212/2214.

Specifically, the protruding wheel 221 may be disc-shaped or cylindrical, and include a top surface 2211 and two side surfaces 2113, wherein the side surface 2113 is annular, and the top surface 2211 is arcuate surfaces and connected with two side surfaces 2113. In an embodiment of the invention, the connecting channel 2216 may be disposed along the axial direction of the protruding wheel 221, wherein one end of the connecting channel 2216 is connected to one side surface 2113 of the protruding wheel 221. The suction channels 2212/2214 may be disposed along the radial direction of the protruding wheel 221, wherein one end of the suction channels 2212/2214 is connected to the top surface 2211 of the protruding wheel 221, and the other end is connected to the connecting channel 2216. For example, the suction channel 2212/2214 may be connected to the connecting channel 2216 vertically.

In an embodiment of the present invention, a recessing wheel 220 is located between two adjacent protruding wheels 221, wherein the connecting channels 2216 of the two adjacent protruding wheels 221 face each other. For example, the opening of the connecting channels 2216 of two adjacent wheel protruding wheel 221 on the side surface 2113 face each other and face the same recessing wheel 220, as shown in FIG. 4.

The valves 30 are respectively disposed within part of the recessing wheels 220. For example, the shape of the valve 30 is arcuate, curved, semi-arc or partial ring shape, and is embedded in the partial surface of part of recessing wheels 220. In an embodiment of the invention, the valve 30 may be disposed in a spaced manner in part of the recessing wheels 220 such that at least one recessing wheel 220 that is located between the two adjacent valves 30 without disposing the valve 30. In practical application, a single valve 30 may fluidly connect the connecting channels 2216 of the adjacent two projection wheel 221, so that the air extractor 25 can extract the gas within the suction channels 2212/2214 of the adjacent two protruding wheels 221 via a single valve 30, and then form the negative pressure on the suction channels 2212/2214.

The valve 30 includes an out surface 311, an inner surface 313 and two side surfaces 315, wherein the two side surfaces 315 are connected to the out surface 311 and the inner surface 313. For example, the out surface 311 and the inner surface 313 may be an arc-shaped curved surface, and the side surfaces 315 are a partially annular plane and are connected with the out surface 311 and the inner surface 313.

The valve 30 mainly includes a connecting opening 36, a valve channel 34 and a plurality of valve openings 32, wherein the connecting opening 36 is located at one end of the valve 30, and the valve openings 32 are respectively located on the two side surfaces 315 of the valve 30, and the connecting opening 36 is fluidly connected to the valve opening 32 through the valve channel 34, as shown in FIG. 6 and FIG. 7.

When the valve 30 is disposed within the recessing wheel 220, the inner surface 313 of the valve 30 will be attached to partial surface of the recessing wheel 220, and the two side surfaces 315 of the valve 30 are attached respectively to the side surfaces 2213 of the adjacent two protruding wheels 221. Thus, the two valve openings 32 are respectively fluidly connected to the suction channels 2212/2214 through the connecting channels 2216, as shown in FIG. 5. In other words, the connecting channels 2216 of the adjacent two protruding wheels 221 will face the valve 30 therebetween.

The air extractor 25 is fluidly connected to the connecting opening 36 of the valve 30. For example, the air extractor 25 is connected to the connecting opening 36 of each valve 30 through a plurality of connecting pipes 38, and is fluidly connected to part of connecting channels 2216 and part of suction channels 2212/2214 of the adjacent protruding wheels 221 through the valve channel 34, the valve opening 32 and the connecting channel 2216 of each valve 30. When the air extractor 25 is activated, the negative pressure will be formed on part of suction channels 2212/2214 of the protruding wheel 221, thereby the fiber product (paper) being sucked on the protruding wheel 221.

Specifically, the folding wheel 22 can be rotating relative to the valve 30, so that part of suction channels 2214 of the protruding wheel 221 of the folding wheel 22 will be fluidly connected to the valve opening 32 of the valve 30 via the connecting channel 2216, and the negative pressure will be formed on part of suction channels 2214 of the protruding wheel 221.

The fiber product suction system of the present invention comprises a plurality of valves 30 respectively disposed within part of recessing wheels 220 of the folding wheel 20, wherein the connecting channel 2216 of each folding wheels 30 is respectively fluidly connected to the connecting opening 36 of the valve 30. Thus, the air extractor 25 is connected to the connecting channels 2216 of each protruding wheel 221 via the valve 30 directly, and the negative pressure can be quickly formed on the suction channels 2212/2214 of the protruding wheel 221.

Specifically, when the air extractor 25 is activated, the same or similar amount of negative pressure can be quickly formed on the suction channels 2212/2214 of the protruding wheel 221. For example, each suction channel 2212/2214 at the same angle of each protruding wheel 221 simultaneously generates the negative pressure, so that the folding wheel 20 is able to produces a uniform suction force to support the high-speed rotation of the folding wheel 20. Even if the length of the folding wheel 20 is long, the suction channel 2212/2214 of the protruding wheel 221 at the middle of the folding wheel 20 does not cause the problem of insufficient suction to avoid the fiber product falling from the folding wheel 20 and generating wrinkle on the fiber product.

Figure 1:
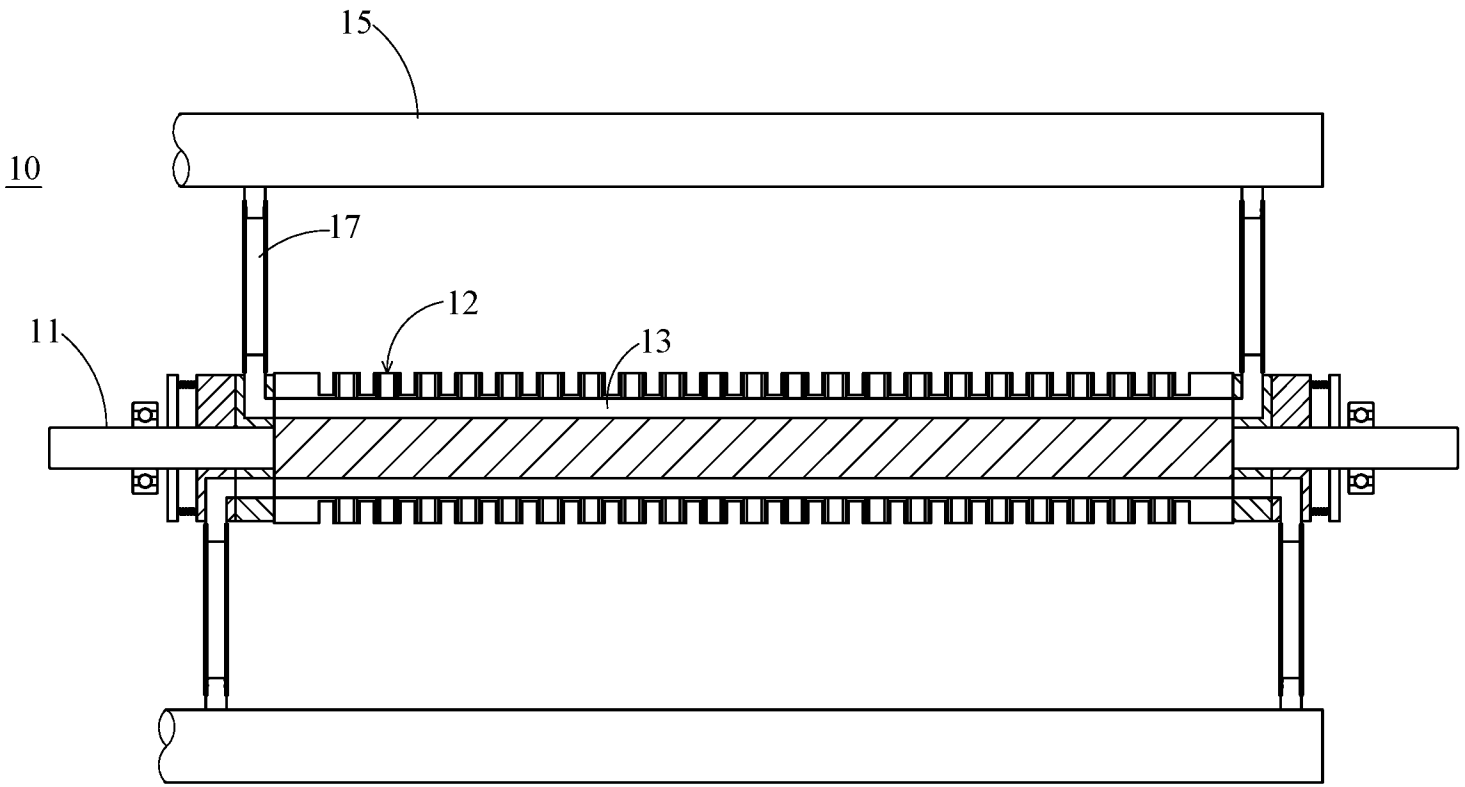
FIG. 1 (PRIOR ART)
FIG. 1 is a cross section view of a folding wheel according to the prior art.
Figure 2:
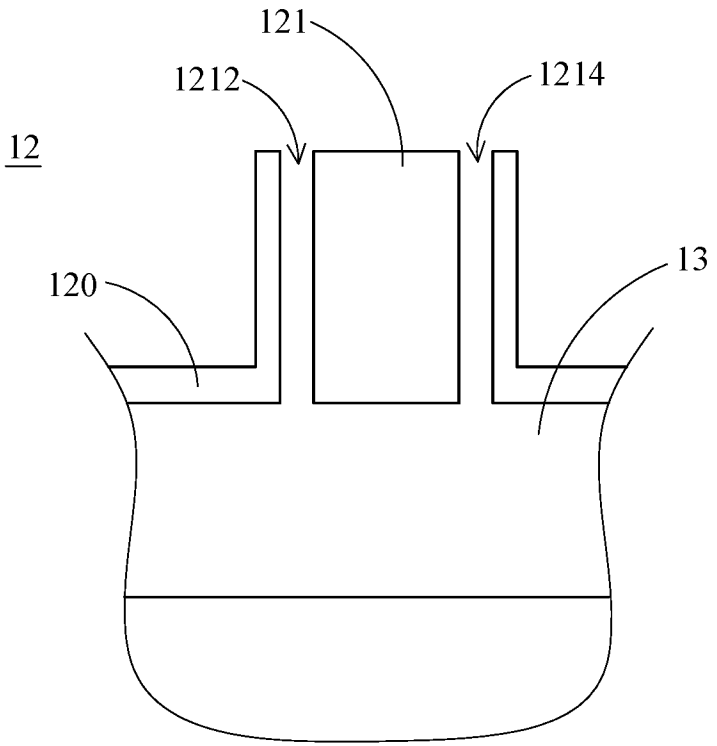
FIG. 2 (PRIOR ART)
FIG. 2 is a cross section view of a protruding wheel of the folding wheel according to the prior art.

The connecting channel 2216 of the folding wheel 20 of the present invention does not extend through the entire folding wheel 20, wherein each connecting channel 2216 is disposed on each of the protruding wheel 221, and the air extractor 25 is fluidly connected to part of connecting channels 2216 of each folding wheel 20 through a plurality of connecting pipes 38 and valves 30. In contrast, the conventional folding wheel 10 described in FIG. 1 the passage 13 extends through the entire wheel 12 or the shaft 11.

In one embodiment of the present invention, the adjacent two recessing wheels 220 are not provided with the valve 30 at the same time. In other words, at least one recessing wheel 220 between two adjacent valves 30 does not dispose the valve 30.

Figure 8:
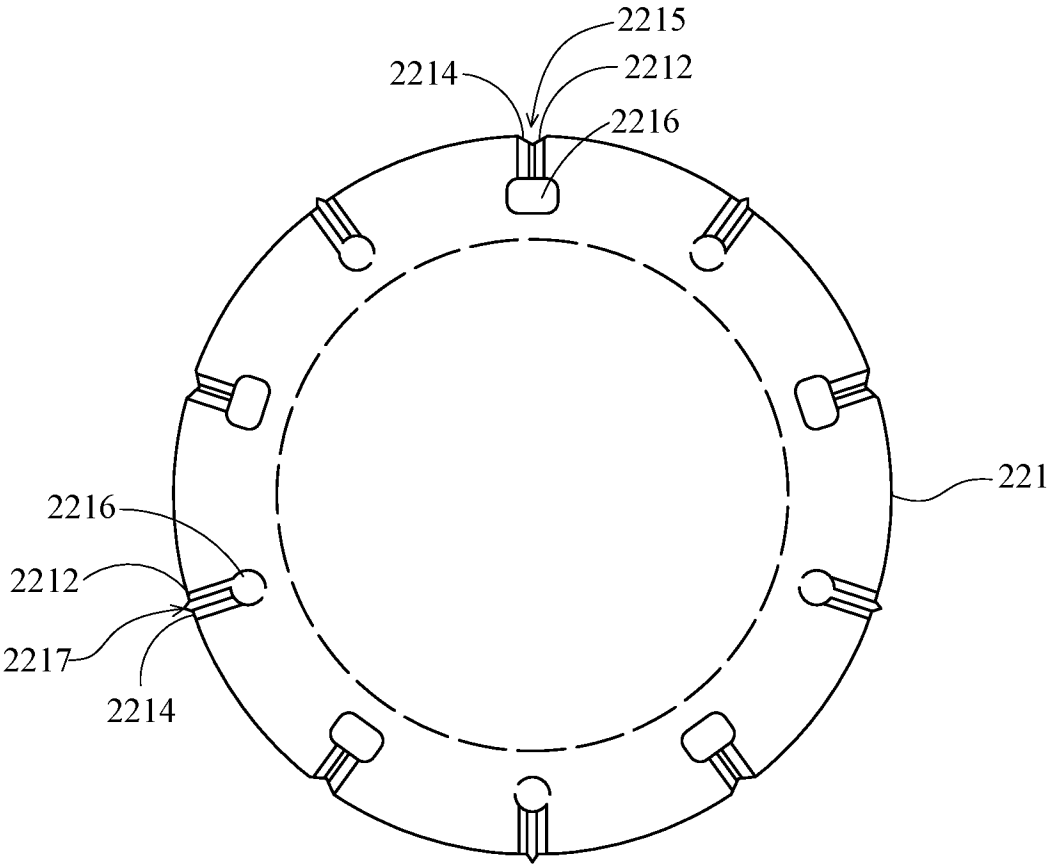
FIG. 8 is a cross section view of a protruding wheel of a fiber product suction system according to an embodiment of the present invention.
Figure 9:
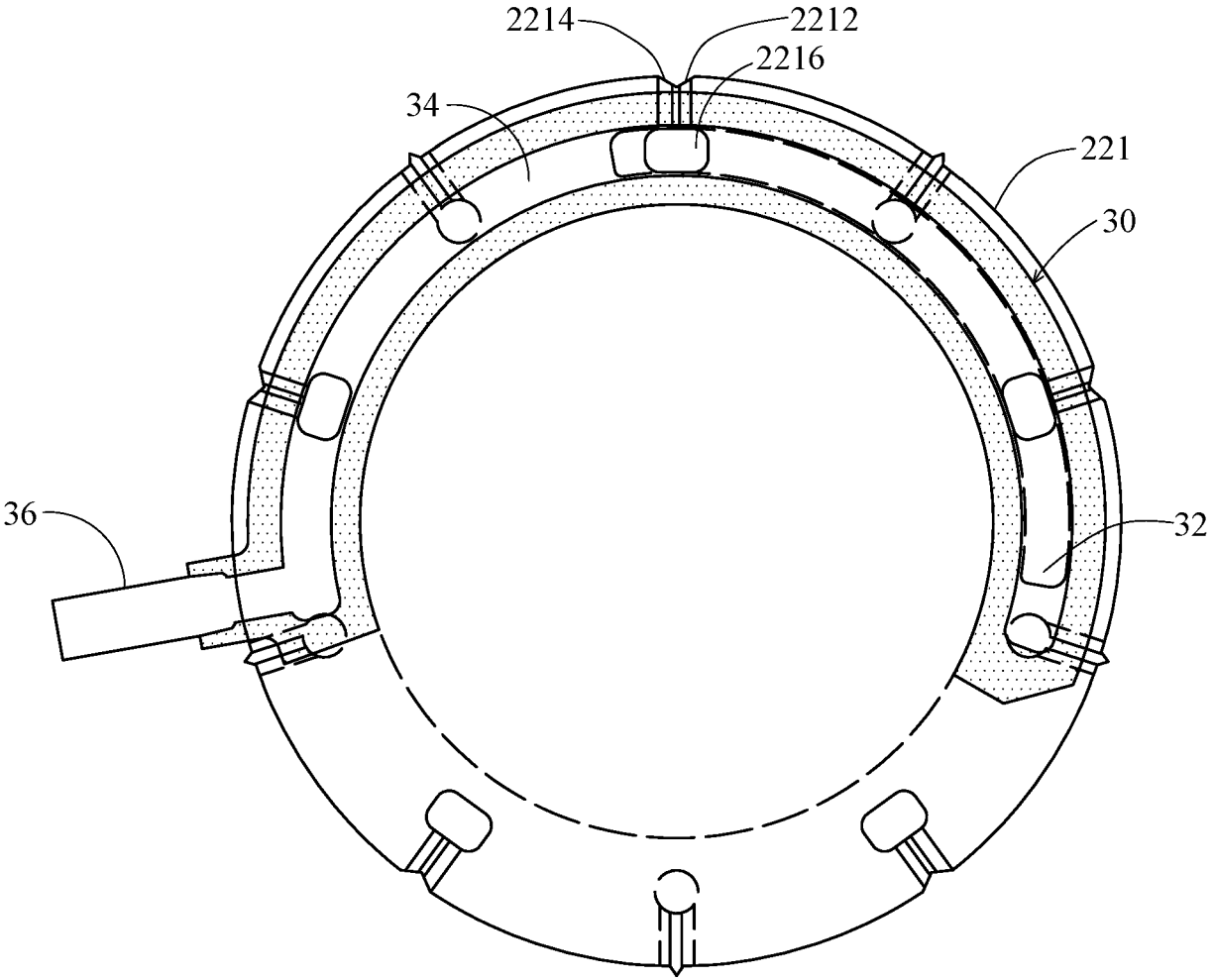
FIG. 9 is a cross section view of a protruding wheel and a valve of a fiber product suction system according to an embodiment of the present invention.

FIG. 8 is a cross sectional view of a protruding wheel of a fiber product suction system according an embodiment of the present invention. FIG. 9 is a cross sectional view of a protruding wheel and a valve of a fiber product suction system according an embodiment of the present invention. The protruding wheel 221 of the folding wheel 20 is provided with a plurality of grooves 2215 and/or protrusions 2217, wherein the groove 2215 and the protrusion 2217 are alternately arranged on the surface of the protruding wheel 221. The suction channels 2212/2214 may be disposed in each of grooves 2215 and adjacent to both sides of each protrusion portion 2217, wherein the suction channels 2212/2214 are fluidly connected to the connecting channel 2216.

When the folding wheel 20 is rotated to the preset position or angle, the air extractor 25 forms the negative pressure on the suction channels 2212/2214 adjacent to part of protrusions 2217 and on the suction channels 2212/2214 located in part of grooves 2215. For example, the suction channels 2221/2214 located on both sides of protrusion 2217 and/or groove 2215 on the same angle of each protruding wheel 221 will simultaneously form the negative pressure.

Specifically, when the folding wheel 20 is rotated to the preset position or angle, part of suction channels 2212/2214 on the protruding wheel 221 will fluidly connect the valve openings 32 located both sides of the valve 30. Thus, the air extractor 25 can extract the gas in the suction channels 2212/2214 fluidly connected with the air extractor 25, and form the negative pressure on the suction channels 2212/2214 to suck and fold the paper.

Figure 10:
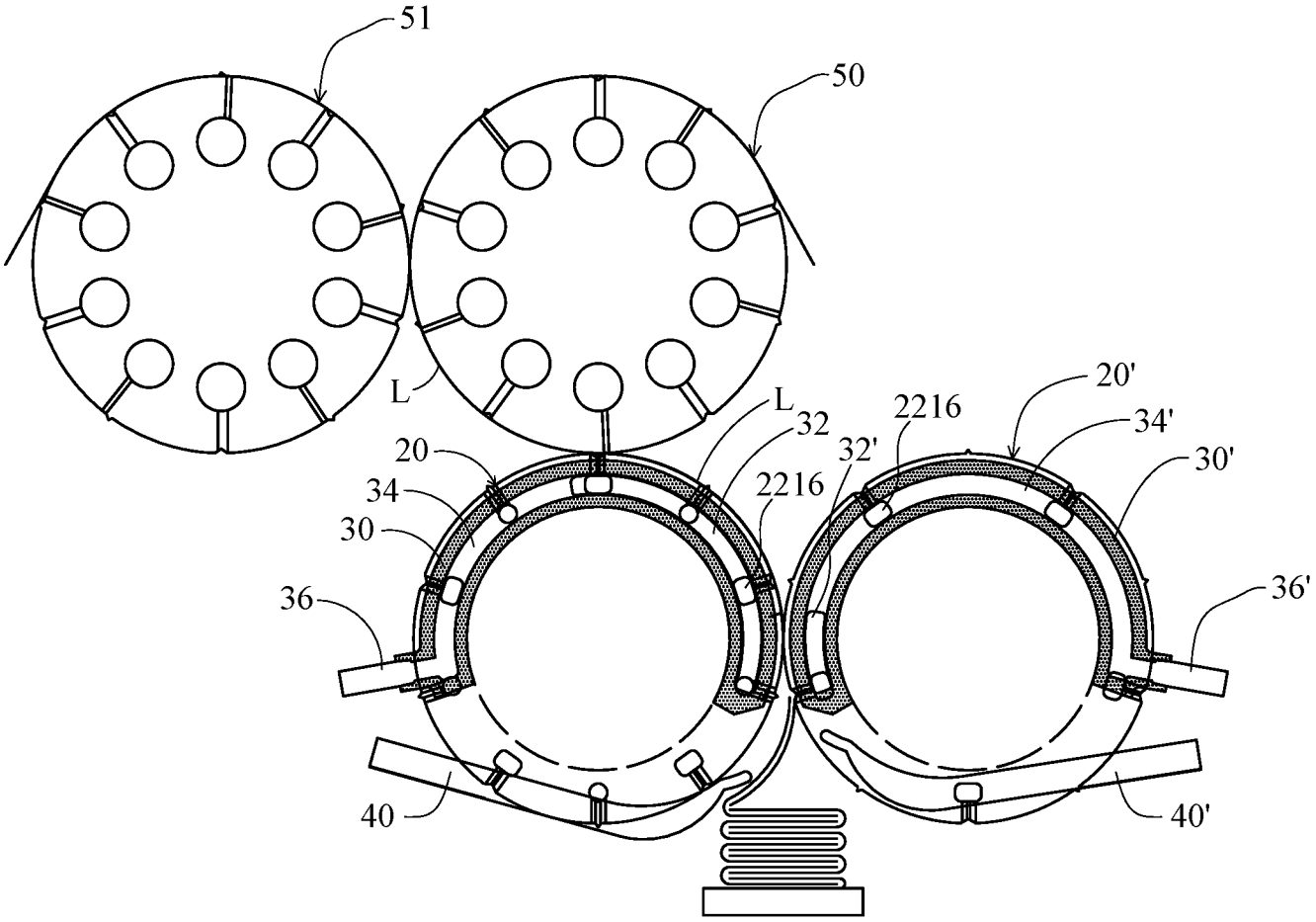
FIG. 10 is a cross section view of a folding mechanism of a fiber product suction system according to an embodiment of the present invention.

FIG. 10 is a cross second view of a folding mechanism of a fiber product suction system according to an embodiment of the present invention. The folding mechanism includes two cutter wheels 50/51, two folding wheels 20/20' and two folding fingers 40/40', wherein two cutter wheels 51/51 are disposed adjacent to each other, and the two folding wheels 20/20' are also arranged adjacently.

The two cutter wheels 50/51 are respectively rotated clockwise and counterclockwise to cut the fiber product L passing therebetween. The two folding wheels 20/20' are also rotated clockwise and counterclockwise respectively, and are used to receive and fold the fiber product L passing therebetween. The folding wheels 20/20' are located downstream of the cutter wheels 50/51, wherein the folding wheel 20 is adjacent to the cutter wheel 50 and receives the fiber product L from the adjacent cutter wheel 50.

When the folding wheel 20/20' is rotated to the preset position, the air extractor 25 will be fluidly connected to part of suction channels 2012/2214 of the folding wheels 20/20' via the valves 30/30'. Thus, the air extractor 25 can extract the gas in part of suction channels 2212/2214 via the connecting openings 36/36', the valve channels 34/34', the valve openings 32/32' and the connecting channel 2216 to form the negative pressure on part of suction channels 2212/2214. The fiber product L passing through the cutter wheels 50/51 can be sucked on the folding wheels 20/20' by the negative pressure on the suction channels 2212/2214. Further, the folding fingers 40/40' swing up and down to fold the fiber product L passing through the folding wheel 20/20.

In summary, the fiber product suction system is able to rapidly generate a uniform negative pressure to facilitate the folding wheel 20/20' high-speed rotation and folding the fiber product L. In addition, it can also avoid the deformation of the fiber product L sucked by the folding wheels 20/20', thereby improving the quality of folded paper.

The above disclosures are only the preferred embodiments of the present invention, and are not to be used to limit the scope of the present invention. All equivalent variations and modifications on the basis of shapes, structures, features and spirits described in claims of the present invention should be included in the claims of the present invention.

What is claimed is:

1. A fiber product suction system comprising:

a folding wheel including a plurality of protruding wheels and a plurality of recessing wheels disposed intermittently adjacent to one another, wherein said plurality of protruding wheels are arranged in a plurality of groups of protruding wheels, and wherein said plurality of recessing wheels include a plurality of first recessing wheels and a plurality of second recessing wheels, wherein each group of protruding wheels is composed of a pair of adjacent protruding wheels of said plurality thereof and a respective first recessing wheel of said plurality thereof disposed between said adjacent protruding wheels of said pair thereof, and wherein adjacent groups of protruding wheels of said plurality thereof are spaced from one another with a respective second recessing wheel of said plurality thereof disposed between said adjacent groups of protruding wheels;

a plurality of suction channels, a suction channel being disposed in each of said plurality of protruding wheels;

at least one connecting channel disposed in said each protruding wheel, said at least one connecting channel being fluidly connected to said suction channel; and a plurality of valves, a valve of said plurality thereof including a connecting opening, a valve channel and at least one valve opening, wherein said connecting opening is fluidly connected to said at least one valve opening through said valve channel, wherein said plurality of valves are respectively disposed in said first recessing wheels in said plurality of groups of protruding wheels, wherein said plurality of second recessing wheels disposed between adjacent groups of protruding wheels are devoid of the valves of said plurality thereof, and wherein said at least one valve opening of the valve of said plurality thereof is fluidly connected to said connecting channel of at least one of said pair of protruding wheels in each of said plurality of groups of protruding wheels.

2. The fiber product suction system of claim 1, wherein said each protruding wheel is disc-shaped or cylindrical, and includes a top surface and two side surfaces, wherein said suction channel in said each protruding wheel is connected to said top surface of said each protruding wheel, and said at least one connecting channel is connected to one of said side surfaces of said each protruding wheel.

3. The fiber product suction system of claim 2, wherein said valve is arcuate, curved, semi-arc or partially annular, and is disposed on a partial surface of said first recessing wheel, and wherein said connecting channels of said pair of adjacent protruding wheels at two sides of said valve in said plurality of groups of protruding wheels are directed toward said valve disposed therebetween.

4. The fiber product suction system of claim 3, wherein said valve includes an outer surface, an inner surface and two side surfaces, wherein said two side surfaces are connected to said outer surface and said inner surface, wherein said inner surface of said valve is attached to a partial surface of said first recessing wheel, and wherein said two side surfaces of said valve are respectively attached to said side surfaces of said pair of adjacent protruding wheels in each of said plurality of groups of protruding wheels.

5. The fiber product suction system of claim 3, wherein valve openings of said valve are respectively disposed on said two side surfaces of said valve, and respectively connected to said connecting channels of said pair of adjacent protruding wheels in said plurality of groups of protruding wheels.

6. The fiber product suction system of claim 2, wherein said suction channel is disposed along a radial direction of said each protruding wheel, and wherein said connecting channel is disposed along an axial direction of said each protruding wheel.

7. The fiber product suction system of claim 1, further comprising an air extractor connecting said connecting opening of each said valve of said plurality thereof via a plurality of connecting pipes respectively, and extracting gas in a part of said connecting channels and a part of said suction channels of said pair of adjacent protruding wheels adjacent to said valve to form a negative pressure on a part of said suction channels.

8. The fiber product suction system of claim 7, wherein said each protruding wheel comprises a plurality of protrusions, wherein said suction channel is disposed adjacent to each of said protrusions, and wherein said air extractor extracts gas in said suction channel to form said negative pressure on said suction channel adjacent to a part of said plurality of protrusions.

9. The fiber product suction system of claim 7, wherein said each protruding wheel includes a plurality of grooves, said suction channel is disposed in each of said grooves, and said air extractor extracts gas in said suction channel to form said negative pressure on said suction channel in a part of said plurality of grooves.

10. The fiber product suction system of claim 1, wherein said folding wheel rotates relative to said valve such that a part of said plurality of suction channels of said each protruding wheel is fluidly connected to said valve opening through said connection channel.

* * * * *